US010662810B2

(12) United States Patent
Avis et al.

(10) Patent No.: US 10,662,810 B2
(45) Date of Patent: May 26, 2020

(54) APPARATUS AND METHOD FOR PROVIDING FLUID TO A BEARING DAMPER

(71) Applicant: UNITED TECHNOLOGIES CORPORATION, Farmington, CT (US)

(72) Inventors: Thomas Bruce Avis, Manchester, CT (US); Michael Dreher, Prospect, CT (US); Erik R. Granstrand, West Hartford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 561 days.

(21) Appl. No.: 15/344,185

(22) Filed: Nov. 4, 2016

(65) Prior Publication Data

US 2018/0128123 A1 May 10, 2018

(51) Int. Cl.
*F01D 25/16* (2006.01)
*F01D 25/18* (2006.01)

(52) U.S. Cl.
CPC ..... *F01D 25/164* (2013.01); *F01D 25/18* (2013.01)

(58) Field of Classification Search
CPC ..... F01D 25/16; F01D 25/164; F01D 25/18; F01D 25/20; F01D 25/22; F01D 25/125
See application file for complete search history.

(56) References Cited

U.S. PATENT DOCUMENTS 6,438,938 B1 8/2002 Burkholder et al.
2015/0219011 A1* 8/2015 Muldoon ..... F02C 7/06 60/39.08

* cited by examiner

*Primary Examiner* — Richard A Edgar
*Assistant Examiner* — Maxime M Adjagbe
(74) *Attorney, Agent, or Firm* — Cantor Colburn LLP

(57) ABSTRACT

Disclosed is a lubricant supply system, for a bearing damper in a bearing housing, the bearing housing in an engine bearing compartment of a gas turbine engine, the bearing compartment rotatably supporting an engine component, including a first interface, a second interface, a bearing supply conduit fluidly coupled to the second interface and extending from the first interface to the second interface, the bearing supply conduit supplying lubricant to the bearing housing, a damper supply conduit located within the bearing supply conduit, extending between the interfaces, the damper supply conduit supplying lubricant to the bearing damper, and fluid in the bearing supply conduit is capable of insulting fluid in the damper supply conduit 108 from heat transferred through the interfaces.

5 Claims, 3 Drawing Sheets

APPARATUS AND METHOD FOR PROVIDING FLUID TO A BEARING DAMPER

BACKGROUND

This disclosure relates to gas turbine engines, and more particularly to an apparatus and method for providing fluid to a bearing damper of a gas turbine engine.

Gas turbine engines are used in numerous applications, one of which is for providing thrust to an aircraft. When a gas turbine engine of an aircraft has been shut off for example, after an aircraft has landed at an airport, the engine is hot and due to heat rise, the upper portions of the engine will be hotter than lower portions of the engine. When this occurs thermal expansion may cause deflection of components of the engine which may result in a "bowed rotor" condition. When starting an engine with a "bowed rotor" condition, a resulting significant rotational imbalance can excite fundamental modes of components of the engine. This in turn produces excessive deflections of the engine rotor, while bowing of the engine case can result in a reduction in normal build clearances and thus results in a potential for rubbing between the rotating turbomachinery and the closed-down case structure. The rub condition can result in a hung start or a performance loss in the turbomachinery.

Accordingly, it is desirable to provide a method and/or apparatus for providing fluid to a bearing damper of a gas turbine engine.

BRIEF DESCRIPTION

Disclosed is a lubricant supply system, for a bearing damper in a bearing housing, the bearing housing in an engine bearing compartment of a gas turbine engine, the bearing compartment rotatably supporting an engine component, comprising: a first interface; a second interface; a bearing supply conduit fluidly coupled to the second interface and extending from the first interface to the second interface; the bearing supply conduit supplying lubricant to the bearing housing; a damper supply conduit located within the bearing supply conduit extending between the interfaces; the damper supply conduit supplying lubricant to the bearing damper; and fluid in the bearing supply conduit is capable of insulating fluid in the damper supply conduit from heat transferred through the interfaces.

In addition to one or more of the features described above, or as an alternative, further embodiments may include that: the first interface connects with a turbine intermediate case; and the second interface connects with the engine bearing housing.

In addition to one or more of the features described above, or as an alternative, further embodiments may include: a first joint where the first interface connects with the bearing supply conduit; a second joint where the second interface connects with the bearing supply conduit, wherein: one of a first joint connection at the first joint and a second joint connection at the second joint is a slip fit; and another of the first joint connection and the second joint connection includes a piloted o-ring.

In addition to one or more of the features described above, or as an alternative, further embodiments may include that the first joint is a piloted o-ring.

In addition to one or more of the features described above, or as an alternative, further embodiments may include that at the first interface: the bearing supply conduit includes a first inlet, the damper supply conduit includes a second inlet, and lubricant flows in separate paths into the inlets.

In addition to one or more of the features described above, or as an alternative, further embodiments may include a bearing housing, which includes: a first bearing housing lubricant passage fluidly coupled to the bearing supply conduit; and a second bearing housing lubricant passage fluidly coupled to the damper supply conduit, and being fluidly separate from the first bearing housing lubricant passage.

Also disclosed is a gas turbine engine, comprising: an engine bearing compartment including a bearing housing and a bearing damper, the bearing compartment rotatably supporting an engine component; a lubricant supply system supplying lubricant to the bearing compartment, including: a first interface; a second interface; a bearing supply conduit fluidly coupled to the second interface and extending from the first interface to the second interface; the bearing supply conduit supplying lubricant to the bearing housing; a damper supply conduit located within the bearing supply conduit, extending between the interfaces; the damper supply conduit supplying lubricant to the bearing damper; and fluid in the bearing supply conduit is capable of insulating fluid in the damper supply conduit from heat transferred through the interfaces.

In addition to one or more of the features described above, or as an alternative, further embodiments may include: a turbine section rotatably supported by the bearing compartment, including a low pressure turbine, a high pressure turbine and a turbine intermediate case; and wherein: the first interface connects with a turbine intermediate case; and the second interface connects with the engine bearing housing.

In addition to one or more of the features described above, or as an alternative, further embodiments may include that the system includes: a first joint where the first interface connects with the bearing supply conduit; a second joint where the second interface connects with the bearing supply conduit, wherein: one of a first joint connection at the first joint and a second joint connection at the second joint is a slip fit; and another of the first joint connection and the second joint connection includes a piloted o-ring.

In addition to one or more of the features described above, or as an alternative, further embodiments may include that the first joint is a piloted o-ring.

In addition to one or more of the features described above, or as an alternative, further embodiments may include that at the first interface: the bearing supply conduit includes a first inlet, the damper supply conduit includes a second inlet, and lubricant flows in separate paths into the inlets.

In addition to one or more of the features described above, or as an alternative, further embodiments may include a bearing housing, which includes: a first bearing housing lubricant passage fluidly coupled to the bearing supply conduit; and a second bearing housing lubricant passage fluidly coupled to the damper supply conduit, and being fluidly separate from the first bearing housing lubricant passage.

Further disclosed is a method of supplying lubricant to a bearing damper of bearing compartment of a gas turbine engine, comprising: fluidly coupling a bearing housing supply conduit to the bearing compartment, the bearing housing supply conduit supplies bearing housing lubricant to a bearing housing; fluidly coupling a bearing damper supply conduit to the bearing damper, wherein the bearing damper supply conduit is located within the bearing housing supply conduit, and supplies lubricant to the bearing damper; and insulating the lubricant in the bearing damper supply conduit from heat transferred through interfaces, and connecting the bearing housing supply conduit to the engine with the bearing housing supply lubricant that flows through an insulating cavity defined between an interior surface of the bearing housing supply conduit and an exterior surface of the bearing damper supply conduit.

In addition to one or more of the features described above, or as an alternative, further embodiments may include that: the interfaces include a turbine intermediate case interface and bearing housing interface; and the bearing housing supply conduit is connected at a first joint to the turbine intermediate case interface and at a second joint to the bearing housing interface, wherein: one of a first joint connection at the first joint and a second joint connection at the second joint is a slip fit; and another of the first joint connection and the second joint connection includes a piloted o-ring.

In addition to one or more of the features described above, or as an alternative, further embodiments may include that the first joint connection includes a piloted o-ring.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
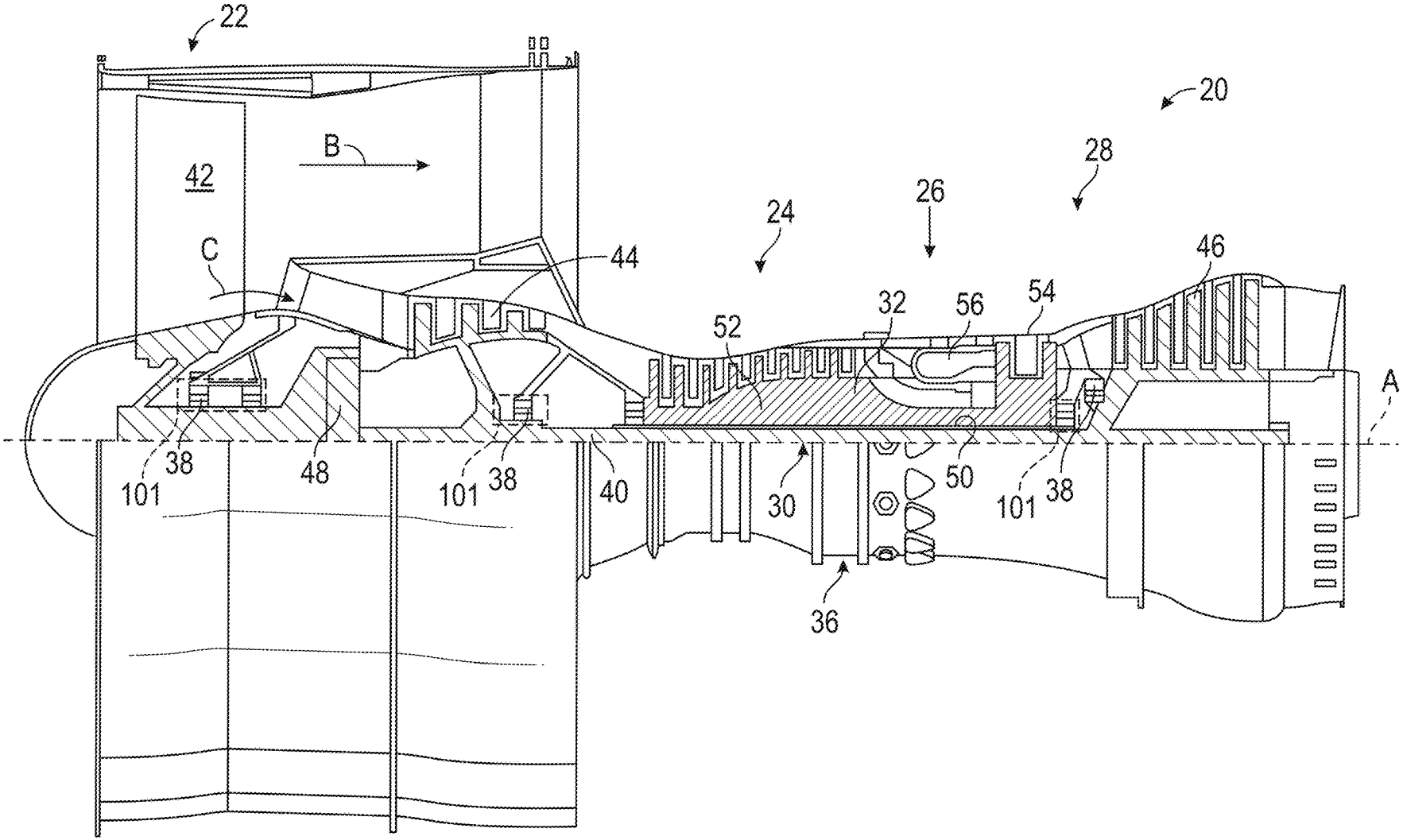
FIG. 1 is cross section of a disclosed gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing compartments 38. It should be understood that various bearing compartments 38 at various locations may alternatively or additionally be provided, and the location of bearing compartments 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing compartments 38 in the turbine section 28. The inner shaft 40 and the outer shaft 50 are concentric and rotate via bearing compartments 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]0.5. The "Low corrected fan tip speed" as disclosed herein according to one non-limiting embodiment is less than about 1150 ft/second (350.5 m/sec).

Various embodiments of the present disclosure are related to a damping system in a gas turbine engine. To assist in minimizing a the potential and impact of a bowed rotor start response, a gas turbine engine employs one or more fluid film/squeeze-film dampers in bearing supports to provide viscous type damping and dissipation of the bowed rotor excitation energy as well as other sources of vibration. However, at low speeds where bowed rotor modes occur in the operating range, the dampers may not always be filled sufficiently with oil or fully pressurized so that the dampers may not be providing sufficient or optimal damping to counteract the bowed rotor response. Additionally, as the oil pumps are typically driven by rotation of the engine, oil pumps used to lubricate and dampen vibrations within a gas turbine engine may not provide sufficient oil pressure at startup and at low speeds.

Moreover, due to exposure to intense heat in the hotter sections of the engine 20, such as in the turbine section 28, and specifically, in the high pressure turbine 54, oil directed to the damper bearings 101 for the high pressure turbine 54 via the turbine intermediate case may heat up and coke.

Specifically, the bearing damper 101 for the high pressure turbine 54 is fed by the oil feed line that supplies oil to the rest of the bearing compartments 38. A bowed rotor in the high pressure turbine 54, caused by heat rising inside the engine 20 during heat soak after shutdown, can cause an imbalance during the next engine start. The imbalance in the high pressure turbine 54 can cause blades to contact the cases during a bowed rotor start which can then lead to loss of stall margin.

The bearing damper 101 in the high pressure turbine 54 can mitigate imbalance in the rotor. As indicated, the damper in the high pressure turbine 54 may be ineffective at start, however, due to low oil pressure, because oil pressure is driven by the engine rotor shaft which slowly spools up. Therefore, with the damper 101 in the high pressure turbine 54 failing at startup to adequately dampen out the imbalance caused by the bowed rotor, start times are purposely longer to prevent rubbing blades out.

Figure 2:
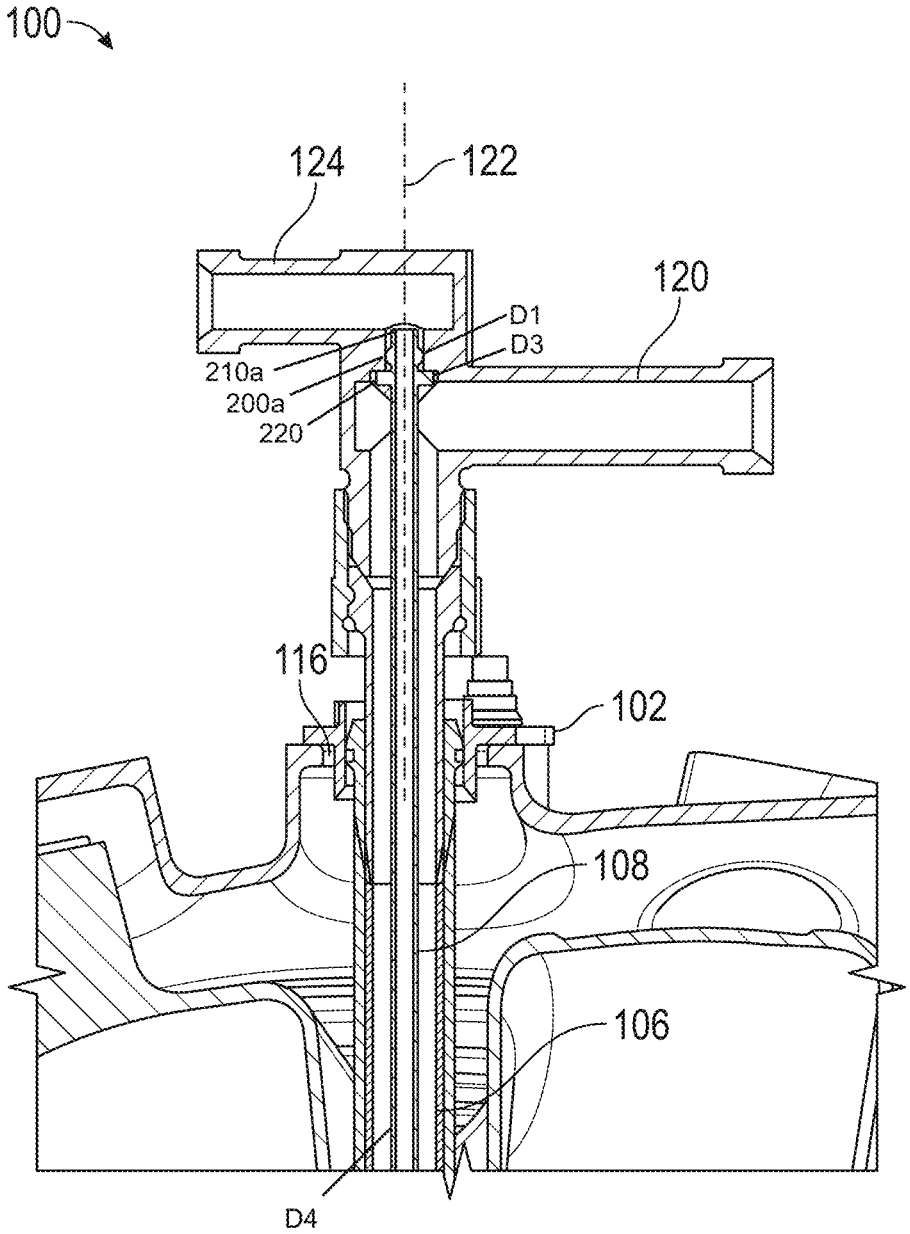
FIG. 2 illustrates a first section of a turbine bearing damper supply according to an embodiment.
Figure 3:
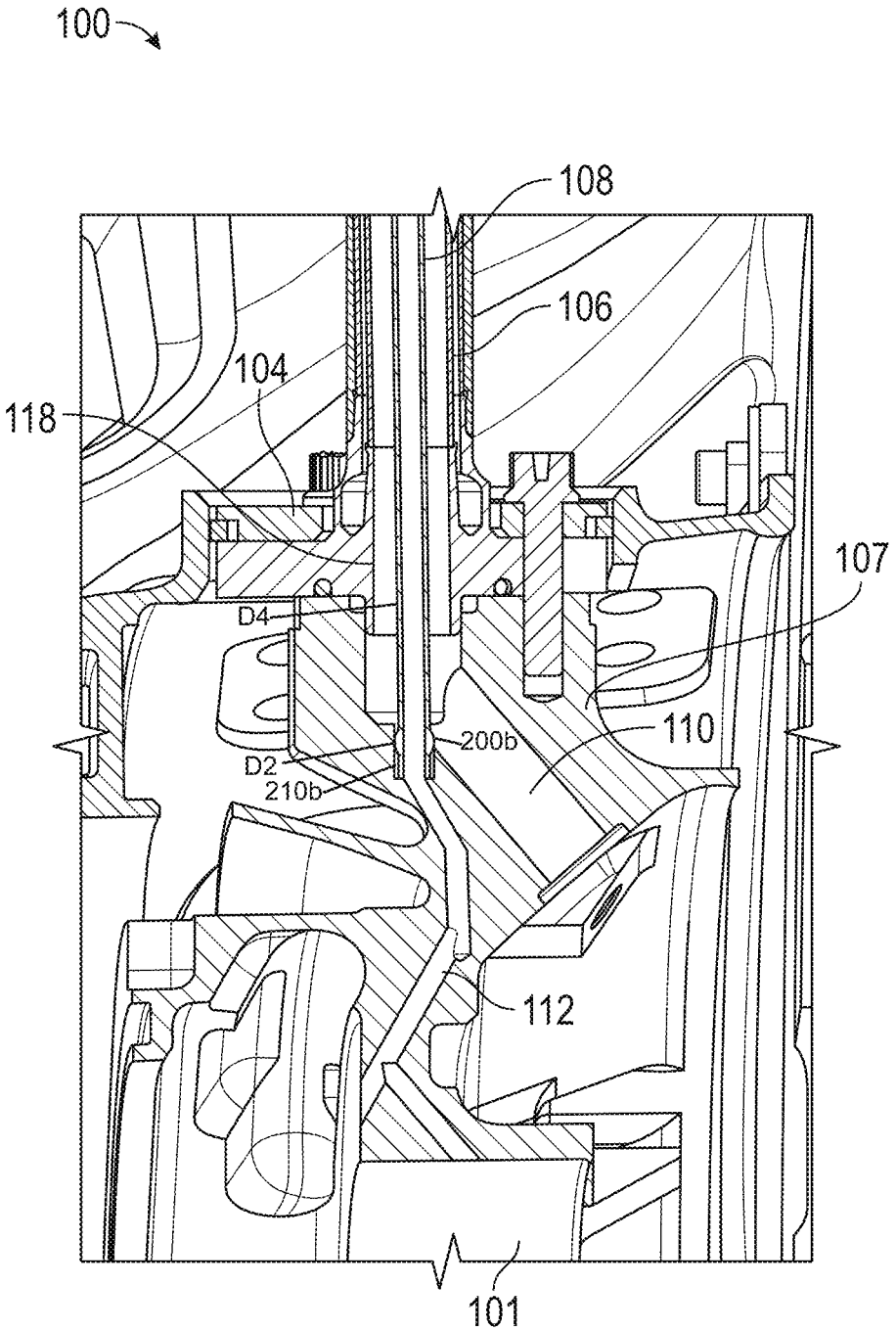
FIG. 3 illustrates a second section of a turbine bearing damper supply according to an embodiment.

Turning now to FIGS. 1-3, a lubricant supply system 100 for a bearing damper 101 of a gas turbine engine 20 is illustrated. Non-limiting locations of bearing dampers 101 are illustrated schematically by the dashed lines in FIG. 1.

The system 100 includes a first interface 102, illustrated in FIG. 2, and a second interface 104, illustrated in FIG. 3. The interfaces 102, 104 are outside the core flow path. The interfaces 102, 104 may heat up because of connections with hotter engine components, due to heat radiating and conducting though the engine. For example, interface 102 may heat up from the turbine intermediate case in the turbine section 28.

A bearing supply conduit 106 for supplying lubricant to a bearing housing 107 is illustrated. The bearing supply conduit 106 may be fluidly coupled to the second interface 104 and extends from the first interface 102 to the second interface 104. A damper supply conduit 108, supplying lubricant to a bearing damper 101 is also illustrated. The damper supply conduit 108 is fluidly coupled to the second interface 104 and extends from the first interface 102 to the second interface 104. According to an embodiment, the damper supply conduit 108 is located within the bearing supply conduit 106, and an insulating cavity is defined between an interior surface of the damper supply conduit 108 and an exterior surface of the bearing supply conduit 106. Additionally, lubricant in each conduit 106, 108 flows in the same direction from the first interface 102 toward the second interface 104, e.g., along axis 122.

The bearing supply conduit 106 is insulted and shielded from heat in the area of exposure to engine core flow. This insulation, however, does not function to insulate from heat transferred via the interfaces 102, 104. In the disclosed system 100, the damper supply conduit 108 inside the bearing supply conduit 106 is insulated from heat transferred through the interfaces 102, 104 by lubricant flowing inside the bearing supply conduit 106. That is, this configuration takes advantage of lubrication passing through the insulating cavity between the outer surface of the damper supply conduit 108 and the inner surface of the bearing supply conduit 106. The relatively cool bearing lubrication (as compared to the temperature outside of the bearing supply conduit 106) moving through the bearing supply conduit 106 will reduce the influence of the heat transferred, e.g., radiated and conducted from the turbine intermediate case into the interface 104 and into the outer surface of the bearing supply conduit 106. By reducing the influence of the heated interfaces 102, 104 on the supply oil in the damper supply conduit 108, this will prevent the supply oil from overheating and coking.

In one embodiment, the first interface 102 is a turbine intermediate case interface for connecting with a turbine intermediate case. The second interface 104 is a bearing housing interface for connecting with a bearing housing 107 in a bearing compartment 38 of a turbine section 28.

As illustrated in FIG. 3, the system 100 includes a bearing housing 107, which includes a first bearing housing lubricant passage 110 fluidly coupled to the bearing supply conduit 106. Additionally, the bearing housing 107 includes a second bearing housing lubricant passage 112 fluidly coupled to the damper supply conduit 108 and fluidly separate from the first bearing housing lubricant passage 110.

As also illustrated in FIG. 2, the system 100 includes a first joint 116, where the first interface 102 connects with the bearing supply conduit 106. As illustrated in FIG. 3, the system 100 includes a second joint 118, where the second interface 104 connects with the bearing supply conduit 106. One of a first joint connection at the first joint 116 and a second joint connection at the second joint 118 is a slip fit. On the other hand, another of the first joint connection and the second joint connection includes a piloted o-ring. As illustrated, the first joint connection may be a piloted o-ring.

Using the piloted o-ring connection enables slippage in along the longitudinal axis of the tube, reducing thermal stress that could occur between the colder damper oil tube and the hotter structure in the bearing system supply conduit 106 due to the above noted heat transfer from the fittings 105, 117 if the bearing supply tube 108 were firmly fixed in place.

Turning back to FIG. 2, in one embodiment, at the first interface 102, the bearing supply conduit 106 includes a first inlet 120 and the damper supply conduit 108 includes a second inlet 124. Lubricant flows in separate paths into the inlets 120, 124, toward the second interface 104. That is, the first and second segments are flow-wise decoupled. With this configuration, adverse start-up pressure conditions that impact lubricant flow to the bearing compartment 38 in the turbine section 28 are isolated from impacting lubricant flow to the damping system 101 in the turbine section 28.

With reference to both FIGS. 2 and 3, the damper supply conduit 108 defines discrete convex portions 200*a*, 200*b* respectively disposed at opposing axial ends 210*a*, 210*b* of the damper supply conduit 108. One of the discrete convex portions 200*a* is located axially between the first inlet 120 and the second inlet 124 (FIG. 2). The discrete convex portions 200*a*, 200*b* define respective diameters D1, D2 of the damper supply conduit 108 thereat.

The damper supply conduit 108 also defines a discrete stepped-out portion 220 (FIG. 2) located axially between the discrete convex portions 210*a*, 210*b*, and more specifically axially between the first inlet 120 and the second inlet 124. The discrete stepped-out portion 220 defines a diameter D3 of the damper supply conduit 108 thereat. The diameter D3 of the damper supply conduit 108 defined by the discrete stepped-out portion 220 is larger than the diameters D1, D2 of the damper supply conduit 108 defined by either of the discrete convex portions 200*a*, 200*b*.

The damper supply conduit 108 defines a substantially constant diameter D4 between the discrete stepped-out portion 220 and the other of the discrete convex portions 200*b*. The substantially constant diameter D4 is smaller than the diameters D1, D2 defined by the damper supply conduit 108 at either of the discrete convex portions 200*a*, 200*b*

In one embodiment, the lubricant supply system 100 is used to supply lubricant to at least one bearing damper 101 of the plural bearing compartments 38 in the engine 20. In the engine, the bearing housing interface 102 of the system 100 is connected with an interface in the bearing housing 107 of the bearing compartment 38 of the turbine section 28. The turbine intermediate case interface 104 of the system is connected with the turbine intermediate case. Further, the bearing damper 101 of the system 100 is a bearing damper 101 for the high pressure turbine.

Also disclosed herein is a method of supplying lubricant to the bearing damper 101 of the bearing compartment 38 of the gas turbine engine 20. The method includes fluidly coupling the bearing housing supply conduit 106 to the bearing compartment 38, the bearing housing supply conduit 106 supplies bearing housing lubricant to a bearing housing 107, and fluidly coupling the bearing damper supply conduit 108 to the bearing damper 101. As indicated, the bearing damper supply conduit 108 may be located within the bearing housing supply conduit 106, and supplies lubricant to the bearing damper 101. The method includes insulating the lubricant in the bearing damper supply conduit 108, from heat transferred through interfaces 102, 104. The method further includes connecting the bearing housing supply conduit 106 to the engine 20, with the bearing housing supply lubricant that flows through an insulting cavity defined between an interior surface of the bearing housing supply conduit 106 and an exterior surface of the bearing damper supply conduit 108.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A lubricant supply system, for a bearing damper in a bearing housing, the bearing housing in an engine bearing compartment of a gas turbine engine, the bearing compartment rotatably supporting an engine component, comprising:

a first interface;

a second interface;

a bearing supply conduit fluidly coupled to the second interface and extending along an axis from the first interface to the second interface;

the bearing supply conduit supplying lubricant to the bearing housing;

a damper supply conduit located within the bearing supply conduit extending between the interfaces;

the damper supply conduit supplying lubricant to the bearing damper; and fluid in the bearing supply conduit is capable of insulating fluid in the damper supply conduit from heat transferred through the interfaces;

the first interface connects with a turbine intermediate case;

the second interface connects with a bearing housing of the engine; and the system further including:

a first joint where the first interface connects with the bearing supply conduit;

a second joint where the second interface connects with the bearing supply conduit;

the bearing housing, comprising:

a first bearing housing lubricant passage fluidly coupled to the bearing supply conduit; and a second bearing housing lubricant passage fluidly coupled to the damper supply conduit, and being fluidly separate from the first bearing housing lubricant passage, the second bearing housing lubricant passage extending at least partially along the axis;

wherein:

the first joint connection at the first joint is a piloted O-ring; and the second joint is a slip fit along the axis, thereby providing a slip fit along the axis against the second bearing housing lubricant passage;

wherein:

at the first interface, the bearing supply conduit includes a first inlet, the damper supply conduit includes a second inlet, and lubricant flows in separate paths into the inlets;

the damper supply conduit defines discrete convex portions respectively disposed at opposing axial ends of the damper supply conduit, wherein one of the discrete convex portions is axially between the first inlet and the second inlet, and wherein the discrete convex portions define respective diameters of the damper supply conduit thereat;

the damper supply conduit defines a discrete stepped-out portion located axially between the discrete convex portions, axially between the first inlet and the second inlet, wherein the discrete stepped-out portion defines a diameter of the damper supply conduit thereat, and wherein the diameter of the damper supply conduit defined by the discrete stepped-out portion is larger than the diameters of the damper supply conduit defined by either of the discrete convex portions; and the damper supply conduit defines a substantially constant diameter between the discrete stepped-out portion and the other of the discrete convex portions, the substantially constant diameter being smaller than the diameters of the damper supply conduit defined by either of the discrete convex portions.

2. A gas turbine engine, comprising:

an engine bearing compartment including a bearing housing and a bearing damper, the bearing compartment rotatably supporting an engine component;

a lubricant supply system supplying lubricant to the bearing compartment, including:

a first interface;

a second interface;

a bearing supply conduit fluidly coupled to the second interface and extending along an axis from the first interface to the second interface;

the bearing supply conduit supplying lubricant to the bearing housing;

a damper supply conduit located within the bearing supply conduit, extending between the interfaces;

the damper supply conduit supplying lubricant to the bearing damper; and fluid in the bearing supply conduit is capable of insulating fluid in the damper supply conduit from heat transferred through the interfaces;

the first interface connects with a turbine intermediate case;

the second interface connects with a bearing housing of the engine; and the system further including:

a first joint where the first interface connects with the bearing supply conduit;

a second joint where the second interface connects with the bearing supply conduit;

the bearing housing comprising:

a first bearing housing lubricant passage fluidly coupled to the bearing supply conduit; and a second bearing housing lubricant passage fluidly coupled to the damper supply conduit, and being fluidly separate from the first bearing housing lubricant passage, the second bearing housing lubricant passage extending at least partially along the axis;

wherein:

the first joint connection at the first joint is a piloted O-ring; and the second joint is a slip fit along the axis, thereby providing a slip fit along the axis against the second bearing housing lubricant passage;

wherein:

at the first interface, the bearing supply conduit includes a first inlet, the damper supply conduit includes a second inlet, and lubricant flows in separate paths into the inlets;

the damper supply conduit defines discrete convex portions respectively disposed at opposing axial ends of the damper supply conduit, wherein one of the discrete convex portions is axially between the first inlet and the second inlet, and wherein the discrete convex portions define respective diameters of the damper supply conduit thereat;

the damper supply conduit defines a discrete stepped-out portion located axially between the discrete convex portions, axially between the first inlet and the second inlet, wherein the discrete stepped-out portion defines a diameter of the damper supply conduit thereat, and wherein the diameter of the damper supply conduit defined by the discrete stepped-out portion is larger than the diameters of the damper supply conduit defined by either of the discrete convex portions; and the damper supply conduit defines a substantially constant diameter between the discrete stepped-out portion and the other of the discrete convex portions, the substantially constant diameter being smaller than the diameters of the damper supply conduit defined by either of the discrete convex portions.

3. The engine of claim 2, further comprising:

a turbine section rotatably supported by the bearing compartment, including a low pressure turbine, a high pressure turbine and a turbine intermediate case; and wherein:

the first interface connects with a turbine intermediate case; and the second interface connects with the bearing housing of the engine.

4. A method of supplying lubricant with a lubricant supply system to a bearing damper of bearing compartment of a gas turbine engine, comprising:

fluidly coupling a bearing supply conduit of the lubricant supply system to the bearing compartment, the bearing supply conduit supplying bearing housing lubricant to the bearing housing;

fluidly coupling a damper supply conduit of the lubricant supply system to the bearing damper, wherein the damper supply conduit is located within the bearing supply conduit, and supplies lubricant to the bearing damper; and insulating the lubricant in the damper supply conduit from heat transferred through interfaces of the lubricant supply system, including a first interface and a second interface, and connecting the bearing supply conduit to the engine with the bearing housing supply lubricant that flows through an insulating cavity defined between an interior surface of the bearing supply conduit and an exterior surface of the damper supply conduit;

wherein the lubricant supply system includes:

the first interface;

the second interface;

the bearing supply conduit fluidly coupled to the second interface and extending along an axis from the first interface to the second interface;

the bearing supply conduit supplying lubricant to the bearing housing;

the damper supply conduit located within the bearing supply conduit extending between the interfaces;

the damper supply conduit supplying lubricant to the bearing damper; and fluid in the bearing supply conduit is capable of insulating fluid in the damper supply conduit from heat transferred through the interfaces;

the first interface connects with a turbine intermediate case;

the second interface connects with a bearing housing of the engine; and the system further including:

a first joint where the first interface connects with the bearing supply conduit;

a second joint where the second interface connects with the bearing supply conduit;

the bearing housing, comprising:

a first bearing housing lubricant passage fluidly coupled to the bearing supply conduit; and a second bearing housing lubricant passage fluidly coupled to the damper supply conduit, and being fluidly separate from the first bearing housing lubricant passage, the second bearing housing lubricant passage extending at least partially along the axis;

wherein:

the first joint connection at the first joint is a piloted O-ring; and the second joint is a slip fit along the axis, thereby providing a slip fit along the axis against the second bearing housing lubricant passage wherein:

at the first interface, the bearing supply conduit includes a first inlet, the damper supply conduit includes a second inlet, and lubricant flows in separate paths into the inlets;

the damper supply conduit defines discrete convex portions respectively disposed at opposing axial ends of the damper supply conduit, wherein one of the discrete convex portions is axially between the first inlet and the second inlet, and wherein the discrete convex portions define respective diameters of the damper supply conduit thereat;

the damper supply conduit defines a discrete stepped-out portion located axially between the discrete convex portions, axially between the first inlet and the second inlet, wherein the discrete stepped-out portion defines a diameter of the damper supply conduit thereat, and wherein the diameter of the damper supply conduit defined by the discrete stepped-out portion is larger than the diameters of the damper supply conduit defined by either of the discrete convex portions; and the damper supply conduit defines a substantially constant diameter between the discrete stepped-out portion and the other of the discrete convex portions, the substantially constant diameter being smaller than the diameters of the damper supply conduit defined by either of the discrete convex portions.

5. The method of claim 4, wherein:

the interfaces respectively include a turbine intermediate case interface and bearing housing interface; and the bearing supply conduit is connected at the first joint to the turbine intermediate case interface and at the second joint to the bearing housing interface.

* * * * *